United States Patent [19]

Daniels

[11] Patent Number: 4,500,198

[45] Date of Patent: Feb. 19, 1985

[54] MULTIPLE ROLLER MAGNETIC BRUSH DEVELOPER HAVING DEVELOPMENT ELECTRODE VOLTAGE SWITCHING

[75] Inventor: Raymond A. Daniels, Thornwood, N.Y.

[73] Assignee: International Business Machines Corporation, Armonk, N.Y.

[21] Appl. No.: 448,577

[22] Filed: Dec. 10, 1982

[51] Int. Cl.[3] ..... G03G 15/08

[52] U.S. Cl. ..... 355/14 D; 355/3 DD; 355/15; 430/125

[58] Field of Search ..... 355/3 DD, 14 D, 14 R, 355/3 R, 15; 430/33, 120, 125; 118/652

[56] References Cited

U.S. PATENT DOCUMENTS

| | | | |
|---|---|---|---|
| 3,637,306 | 1/1972 | Cooper | 355/15 |
| 3,640,707 | 2/1972 | Caldwell | 355/15 X |
| 3,647,293 | 3/1972 | Queener | 355/15 |
| 3,649,262 | 3/1972 | Cade et al. | 355/15 X |
| 3,805,739 | 4/1974 | Feldeisen et al. | 118/637 |
| 3,838,921 | 10/1974 | Sargis | 355/15 |
| 3,985,099 | 10/1976 | Nagashima et al. | 118/637 |
| 4,017,170 | 4/1977 | Komori et al. | 355/3 R |
| 4,087,170 | 5/1978 | Sawaoka et al. | 355/3 CH |
| 4,142,165 | 2/1979 | Miyakawa et al. | 355/14 |
| 4,205,912 | 6/1980 | Yamaguchi et al. | 355/15 |
| 4,266,868 | 5/1981 | Bresina et al. | 355/3 DD |
| 4,279,942 | 7/1981 | Swapceinski | 427/14.1 |

OTHER PUBLICATIONS

IBM Technical Disclosure Bulletin, vol. 24, No. 7B, Dec. 1981, "Magnetic Brush Xerographic Development", by J. E. Bierschbach et al., pp. 3782-3784.

IBM Technical Disclosure Bulletin, vol. 23, No. 11, Apr. 1981, "Independent Biasing within Development Zone", by L. D. Witcher, pp. 5103-5104.

*Primary Examiner*—A. C. Prescott

*Attorney, Agent, or Firm*—Francis A. Sirr

[57] ABSTRACT

A two-cycle xerographic device having a multiple-roller magnetic brush developer which sequentially develops and then cleans the device's reusable photoconductor. The photoconductor provides one or more image panels for each revolution of the photoconductor. The photoconductor's interimage area, which separates the trailing edge of one panel from the leading edge of the same panel, or the leading edge of the next panel, is smaller (as measured in the direction of photoconductor movement) than the similar dimension spanned by the developer's spaced multiple rollers. As the panel's trailing edge leaves the first to-be-encountered roller, that roller's development electrode bias voltage is switched from a development to a cleaning bias. This switching function occurs sequentially, from one roller to the next, thus facilitating a small interimage area, and maximum photoconductor usage.

4 Claims, 6 Drawing Figures

MULTIPLE ROLLER MAGNETIC BRUSH DEVELOPER HAVING DEVELOPMENT ELECTRODE VOLTAGE SWITCHING

BACKGROUND OF THE INVENTION

Since the present invention finds particular utility in two-cycle xerographic devices, making use of a single magnetic brush developer to sequentially develop and then clean the photoconductor, a brief description of this art is in order.

The use of a single magnetic brush developer station to first tone or develop the photoconductor, during a first cycle of the photoconductor through the developer, and to later clean that same photoconductor area, as that area passes through the developer during a second cycle, is well known in the art.

U.S. Pat. No. 3,647,293 is believed to be the pioneer patent disclosing combined developing/cleaning by the use of a magnetic brush developer. In this patent, it is recognized that it may be necessary to change the developer's development electrode bias, depending upon the mode (developing or cleaning) in which the developer is then operating. The need to change this bias is said to be a function of photoconductor voltage during the cleaning cycle, and, if the photoconductor is adequately discharged, the same bias voltage should be adequate for both functions.

This is also the general teaching of U.S. Pat. No. 3,637,306.

U.S. Pat. No. 4,205,912 is of interest in that a photoconductor drum makes two revolutions or cycles in order to produce one copy. In the first cycle, the photoconductor is charged negatively, and the original document's negative latent image is toned by positively charged toner, as this image passes through a magnetic brush developer which is supplied with a negative development electrode bias voltage. This photoconductor-carried toner is then transferred to paper at a negative corona transfer station. In the second photoconductor cycle, the photoconductor and its residual toner (the toner which did not transfer to paper) are subjected first to a preclean erase lamp and then to a positive polarity preclean corona. As a result of this latter corona, any residual toner which was charged negative at the transfer station is charged back to its original positive state. This positive residual toner now enters the magnetic brush developer (now operating as a cleaning station), and the positive toner is cleared from the photoconductor due to the developer's negative bias voltage.

U.S. Pat. No. 4,087,170 also discloses this type of two-cycle device.

Another two-cycle arrangement whereby a magnetic brush developer affects both development and cleaning is shown in U.S. Pat. No. 4,142,165. In this patent, the same development electrode bias voltage is used for both development and cleaning. However, a scavenging electrode in the form of a roller is provided to electrostatically remove a predetermined amount of toner from the magnetic brush prior to the toner's entering the cleaning nip at the photoconductor. This magnetic brush, now somewhat depleted of tonor, is said to better clean residual toner from the photoconductor.

The present invention makes use of what is known as a multiple brush magnetic brush (i.e. multiple magnetic brush rollers) developer. Such developers per se, are known in art and are exemplified by U.S. Pat. Nos. 3,805,739; 3,985,099; 4,266,868 and 4,279,942.

In U.S. Pat. No. 3,805,739 the development electrode bias voltage is capable of a magnitude change in order to control copy print quality.

In U.S. Pat. No. 3,985,099 the magnetic polarity alternates from roller to roller.

In U.S. Pat. No. 4,266,868 each roller's nonmagnetic outer sleeve and inner magnet assembly is capable of independent rotation.

In U.S. Pat. No. 4,279,942 the roller's inner magnet assembly is capable of position-adjustment, whereby the toner's electrical conductivity is said to change, i.e. becomes higher as the toner is packed together more tightly.

The aforesaid patents are hereby incorporated by reference as illustrative of the state of the xerographic art, the two-cycle process and multiple roller magnetic brush developers.

The present invention makes use of development electrode bias voltage switching, as a function of the ever-changing position of a moving xerographic photoconductor.

The IBM TECHNICAL DISCLOSURE BULLETIN, December 1981, at pages 3782 to 3784, describes switching a magnetic brush developer's development electrode bias voltage as a function of the position of the drum seal of an incrementing photoconductor drum, to prevent carrier beads from being carried out of the developer.

The IBM TECHNICAL DISCLOSURE BULLETIN of April 1981, at pages 5103 and 5104, describes a multiple-brush developer where adjacent rollers have different levels of bias voltage, to thereby effect different latent image development characteristics at each roller.

SUMMARY OF THE INVENTION

In a magnetic brush developer as used in a two-cycle xerographic device, it is customary to switch the development electrode bias voltage in order to make the developer selectively function first as a developer for the photoconductor's latent image, and then as a cleaner for the photoconductor's residual toner.

The switching of development electrode voltage must occur after the latent image has been toned, in order to prevent degradation of the copy or print quality. In other words, switching of the development electrode voltage always occurs outside of the latent image area.

It is also desirable to provide a magnetic brush developer having multiple rollers, since it is known that these developers provide high quality copies or prints, over a broad range of copy-per-minute speeds.

The present invention allows use of such a multiple roller developer in a two-cycle process, while at the same time minimizing the area of the photoconductor which must be devoted to the interimage area(s), and thus left unused. The method and apparatus of the present invention provides for sequential switching of the development electrode bias voltage, for each individual development roller, as the transition line between a photoconductor image area and its trailing interimage area arrives at that individual roller. As this line advances past each roller, in sequence, the bias for each roller is switched. Thus, while the voltage is switched at different times, insofar as photoconductor position is concerned, the voltage is switched at the same one line on the photoconductor. This means that at times, as this line passes through the developer, one pair of adjacent rollers momentarily has two different development electrode voltages thereon.

In this way, the photoconductor's interimage area is minimized, and as a result, the utilization of a given loop of photoconductor, be it a drum or belt, is maximized, and the process speed (i.e., photoconductor speed) is minimized for a specific copy production speed.

State of the art xerographic control devices operate upon the output of a photoconductor position transducer in order to control the various xerographic stations, and that same transducer's output is used, in accordance with the present invention, to control the aforesaid time and position of switching of the individual roller bias. If the reproduction device is of the seamless drum or belt-type, a process-control clock can be used to control the various xerographic stations.

The foregoing and other objects, features and advantages of the invention will be apparent from the following more particular description of the preferred embodiments of the invention, as illustrated in the accompanying drawing.

DESCRIPTION OF THE PREFERRED EMBODIMENTS

A xerographic reproduction device in accordance with the present invention can take a great variety of specific forms. Therefore, the form disclosed herein is not to be taken as a limitation on the present invention.

Figure 1:
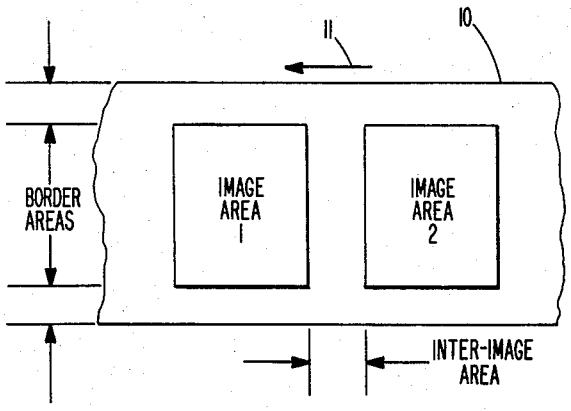
FIG. 1 defines the three photoconductor areas, image area, interimage area and border area.

FIG. 1 shows a portion of a xerographic photoconductor 10 in its flat state. This photoconductor may be either of the drum or the belt type. In either event, it comprises one or more working areas, designated image areas, as well as nonworking areas, designated border and interimage areas. Arrow 11 designates the direction in which the cyclical photoconductor moves relative the stationary xerographic stations, such as the various coronas and the illumination station.

As is well known in the art, the entire photoconductor surface is initially charged to a relatively high DC voltage, for example, −800 volts. As this charged photoconductor moves on its way to the device's illumination, or imaging station, it may first encounter an erase station whereat the photoconductor's nonworking areas are subjected to discharging illumination. As a result, only the image areas remain charged to −800 volts as the photoconductor subsequently passes through the illumination/imaging station. Of course, as an alternative, the erase station can be positioned at or after the illumination/imaging station, but before the developing station. In addition, erase by illumination can be accomplished from the front or back of the photoconductor, particularly in the case of a belt type photoconductor.

In either event, the effect of the illumination station is to leave a −800 volt latent image of the document's image (usually a black image), and a substantially discharged background area (about −50 volts) in all other portions (usually the document's white background) of the photoconductor's image area.

When the photoconductor later passes through the developing station, it encounters toner particles which carry a positive charge. These particles are electrostatically attracted to only the photoconductor's −800 volts latent image. As a result, a reverse-reading, visible toner image is produced on the photoconductor's working or image area.

A belt photoconductor 10 may include as many as seven or nine image areas in one complete revolution of the belt, whereas a drum photoconductor usually has less and may include only one image area.

As the next step of the two-cycle process, the major portion of the photoconductor's toner image is electrostatically transferred to copy medium, such as paper for example, by the use of a negative polarity transfer corona. Some residual toner is left on the photoconductor. This residual toner must be cleaned from the photoconductor during the second cycle of the two-cycle device, so as not to interfere with the next imaging cycle.

FIG. 2 shows the various voltage levels which exist during the first cycle of a two-cycle copier device.

The present invention will be described by the illustrative use of a charged-area-development copier device, as distinguished from a discharged-area-development printer device which uses a reversal-development xerographic process. However, the present invention is of equal utility in each device.

As is well known to those skilled in the xerographic art, a copier provides for the discharge of the photoconductor's latent image in those areas which are not to be toned; i.e., the copy will be white (untoned) where the original document is white. A printer may be of the aforesaid copy type, such as the IBM 6670 Information Distributor, or may use the reversal-development process, such as the IBM 3800 laser printer. In a 3800-type reversal-xerographic-process printer, the photoconductor is discharged (as by use of a scanning laser beam) in those areas which will be toned on the copy, and it is left charged where the copy is to be untoned. As can be appreciated, the toner particles for a copier and a printer are therefore of opposite polarity (for the same photoconductor initial charge, of say −800 volts). Also, the development electrode voltage is of opposite polarity. In a printer, it is not necessary to provide the aforesaid border and interimage erase.

Figure 2A:
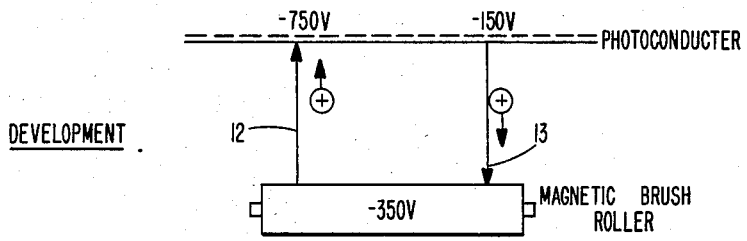
FIG. 2*a* shows the voltage relationship which exists during the development cycle of a two-cycle xerographic device, wherein the device is of the charged-area-development type, i.e., a copier.

As mentioned by way of example only, the copier's photoconductor (FIGS. 2*a* and 2*b*) is full-surface charged to −800 volts, and the border and interimage areas are discharged to −50 volts. The device's illumination station leaves the image area with a pattern of a latent image voltage level of about −750 volts, and a background voltage level of about −150 volts (FIG. 2*a*).

The voltage level, designated as development level of −350 volts, is the voltage level upon which the positive toner particles reside. As shown in FIG. 2*a* by arrows 12 and 13, such a positive toner particle is subjected to a negative-going electrical field in the photoconductor's latent image area, and to a positive-going field in the background area of the document to be reproduced. This causes toner to be attracted by the latent image, and to be repelled by the background area.

Figure 2B:
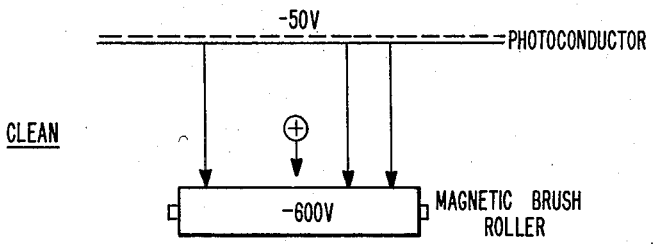
FIG. 2*b* shows the cleaning cycle voltage relationship for the FIG. 2*a* device.

FIG. 2*b* shows the device's second cycle, i.e. the cleaning cycle. In this cycle, erase lamps and the like are used to produce a substantially full-surface discharged photoconductor, here represented as an exemplary −50 volts, before the photoconductor enters the developer to be cleaned thereby. In this cycle the development electrode voltage level changes to −600 volts. The photoconductor's residual toner, which is still positive in polarity, is subjected to a negative-going field, and as a result, this toner moves from the photoconductor to the developer as the toner is dislodged from the photoconductor by the magnetic brushes' developer action, i.e. the photoconductor is cleaned.

Figure 3A:
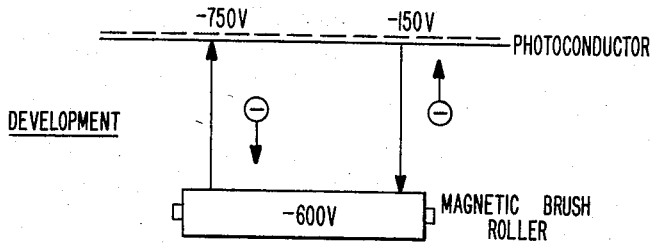
FIG. 3*a* shows the voltage relationship which exists during the development cycle of a two-cycle xerographic device, wherein the device is of the discharged-area-development type, i.e., a printer.
Figure 3B:
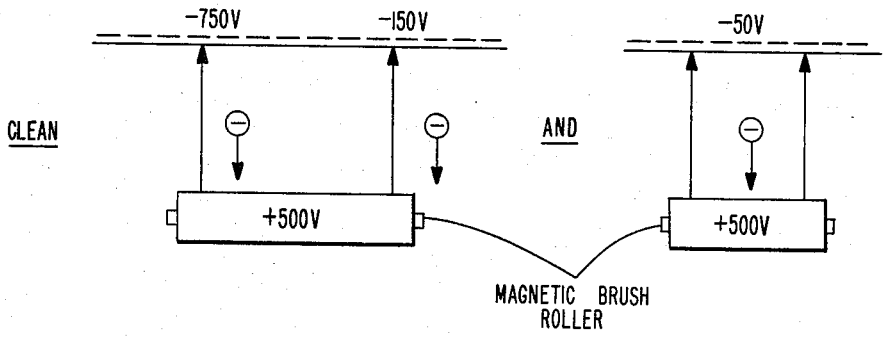
FIG. 3*b* shows the cleaning cycle voltage relationship for the FIG. 3*a* device.

In a two-cycle, reversal-development printer, also called a discharged-area-development device, the development and cleaning cycles are shown by FIGS. 3*a* and 3*b*, respectively. Here, the negative toner particles are attracted to the photoconductor's discharged area (−150 volts of FIG. 3*a*), and they are repelled by the −750 volts charged area of the photoconductor, due to the development electrode voltage of −600 volts. During the cleaning cycle, FIG. 3*b*, the development electrode voltage is charged in both polarity and magnitude, to +500 volts. As a result, negative toner in all photoconductor areas (−750V, −150V and −50V) is subjected to a field which attracts toner to the magnetic brush roller.

The use of a two-cycle process results in a small, compact device, and as a result, it is an attractive process.

In addition, the use of magnetic brush development having more than one development roller, is desirable due to the high copy quality which is achieved therefrom.

The state of the art merging of these two technologies, however, requires a large interimage area—at least equivalent to the distance spanned by the developer's multiple brushes, and thus, some of the advantages of the two-cycle process are lost.

The present invention solves this problem.

Figure 4:
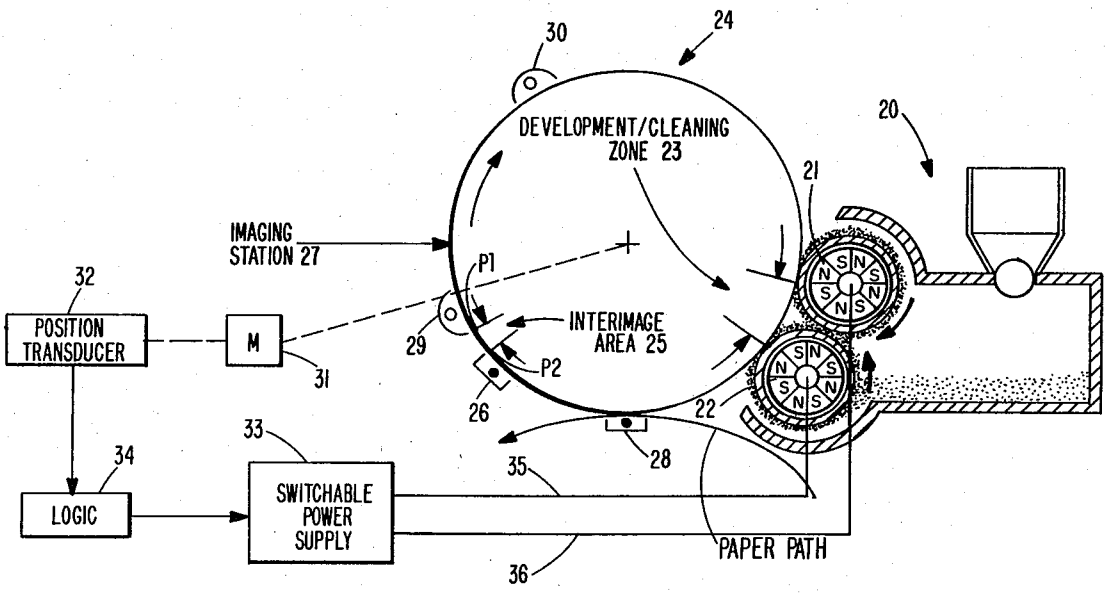
FIG. 4 is a drum-type, charged-area-development xerographic device operating in accordance with FIGS. 1–3 and incorporating the present invention.

As seen in FIG. 4, a multiple brush magnetic brush developer 20 includes two exemplary development/cleaning rollers 21 and 22. No attempt has been made to show all details of such a developer since developers of this type are well known in the art and can take a variety of forms in accordance with the present invention. It is important however to note that such developers inherently have a relatively long development/cleaning zone, identified as 23.

Photoconductor 10 is in this case shown as a drum 24 having but one image area thereon. The leading and trailing edges of this image area are separated by a relatively small interimage area 25, i.e. small as compared to large development/cleaning zone 23. In FIG. 4, the interimage's leading edge (the latent image's trailing edge) is identified as P1, and its trailing edge is identified as P2.

FIG. 4 shows a negative charge corona 26, a latent image forming illumination station 27 and a negative transfer corona 28, all of which are conventional to a two-cycle process. In addition, conventional border and interimage erase illumination station 29 and preclean erase illumination station 30 are shown. If desired, a preclean AC corona, with or without a positive DC bias, can also be provided and operated during the device's cleaning cycle.

Drum 24 is driven clockwise at a constant speed by state of the art means such as motor 31. State of the art sequential control of the two-cycle process is achieved by means not shown, which means is responsive to the output of motor/drum position transducer 32. In accordance with the present invention, position transducer 32 provides a unique output to switching power supply 33, by way of logic 34, as the two photoconductor positions P1 and P2 pass through development/cleaning zone 23. Power supply 33 is connected to development rollers 21 and 22 by two separate conductors 35 and 36. Thus, in accordance with the present invention, roller 22 can have a development voltage thereon as roller 21 has a cleaning voltage thereon. In this manner, the present invention accommodates the narrow interimage area 25 in a two-cycle process.

During the development cycle of this device, both rollers have the aforesaid development bias applied thereto. However, as the trailing edge P1 of the image area leaves the nip of roller 21, and the leading edge of the interimage area simultaneously arrives at this nip, the bias of roller 21 is switched from the development bias to the aforesaid cleaning bias. Roller 21 now has a cleaning bias applied thereto, whereas roller 22 has the development bias applied thereto. A short time thereafter, the transition line P1 between the image area and the interimage area arrives at the nip of roller 22, and the aforesaid voltage switching now occurs at that roller. Rollers 21 and 22 are kept at the cleaning level until the entire photoconductor has been subjected to the cleaning action of the developer. Later, when the image area's leading edge P2 next enters the nip of roller 21, preparatory of toning the next image, the present invention's sequential switching from the cleaning bias to the developing bias occurs.

As mentioned, the aforesaid description of the present invention will enable those skilled in the art to apply the present invention to a variety of xerographic devices, such as reverse-development printers.

While the invention has been particularly shown and described with reference to preferred embodiments thereof, it will be understood by those skilled in the art that various changes in form and details may be made therein without departing from the spirit and scope of the invention.

What is claimed is:

1. A two-cycle xerographic device having a reusable photoconductor with at least one image area and one interimage area thereon, and a plurality of xerographic facilities for performing the charging, imaging and transferring functions, said device including:

a multiroller magnetic brush developer and development electrode voltage source means therefor; and control means responsive to the instantaneous position of said interimage area relative the position of each of the individual rollers of said magnetic brush, and operable to control said voltage source means so as to change an individual roller's voltage from a development mode to a cleaning mode as the leading edge of the interimage area encounters each of said individual rollers of said developer during the second cycle of the device.

2. The two-cycle device defined in claim 1 wherein the distance spanned by the rollers of said magnetic brush developer, as measured in the direction of photoconductor movement, is greater than the similar distance spanned by said interimage area.

3. The two-cycle device of claim 2 wherein said magnetic brush developer is mounted at a fixed position and the transition between an image area and its trailing interimage area is a line which is generally parallel to the parallel axis of said rollers, and transducer means connected to said control means and responsive to photoconductor movement and operable to signal the arrival of said transition at each of said individual rollers.

4. A method for sequentially developing and then cleaning a reusable photoconductor in a two-cycle xerographic process, by the use of a magnetic brush developer which first functions as a developer in the presence of a development bias, and then as a cleaner in the presence of a cleaning bias, the improvement comprising the steps of:

providing a fixed-position magnetic brush developer having more than one development roller, such that the aggregate of said rollers span a given distance, as measured in the direction of photoconductor movement;

providing a cyclically-movable photoconductor having at least one interimage area which is smaller than said given distance spanned by said rollers;

sensing the moving position of the leading edge of said interimage area relative said developer; and sequentially switching the bias voltage of each of said rollers from said development bias to said cleaning bias as said leading edge sequentially arrives at a roller.

* * * * *